US005676370A

United States Patent [19]

Taniguchi et al.

[11] Patent Number: 5,676,370

[45] Date of Patent: Oct. 14, 1997

[54] PAPER FEEDING UNIT

[75] Inventors: Akihiko Taniguchi, Yamatokoriyama; Hideo Taniguchi, Nara; Kenichi Maeda, Yamatokoriyama, all of Japan

[73] Assignee: Sharp Kabushiki Kaisha, Osaka, Japan

[21] Appl. No.: 602,454

[22] Filed: Feb. 16, 1996

[30] Foreign Application Priority Data

Mar. 6, 1995 [JP] Japan ..... 7-045155

[51] Int. Cl.[6] ..... B65H 1/00

[52] U.S. Cl. ..... 271/265.02; 271/145; 271/171

[58] Field of Search ..... 271/9.06, 145, 271/171, 265.02, 265.03; 355/311; 399/389, 376

[56] References Cited

U.S. PATENT DOCUMENTS 5,539,512 7/1996 Mui ..... 271/171

FOREIGN PATENT DOCUMENTS 4302417 7/1993 Germany ..... 271/9.06

360056741 4/1985 Japan ..... 271/171

62-13941 1/1987 Japan .

117524 5/1990 Japan ..... 271/171

3-82330 8/1991 Japan .

404049144 2/1992 Japan ..... 271/171

4-327431 11/1992 Japan .

406100198 4/1994 Japan ..... 271/171

*Primary Examiner*—H. Grant Skaggs

[57] ABSTRACT

A paper feeding unit includes: a detecting board formed of a regular-polygonal prism having a multiple number of sensors; a detection block with sides which each have a multiple number of signal generating portions and are able to face the sensors; a holder portion holding the detection block so as to allow the posture of the block to be changed to fix the block at setup positions; and a display window which allows a paper-size indicator displayed on the signal generating portions of the detection block to be seen from the outside. In this configuration, the orientation and position of the detection block are adapted to be changed in accordance with the size of paper held in the paper feed cassette.

25 Claims, 12 Drawing Sheets

FIG. 8A
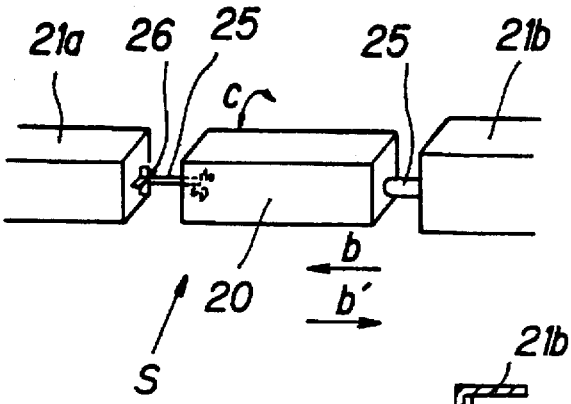
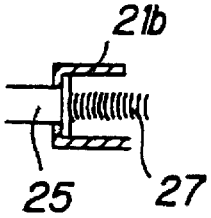
FIG. 8B
FIG. 8C
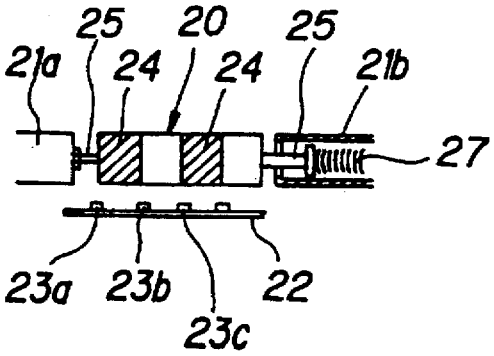

PAPER FEEDING UNIT

BACKGROUND OF THE INVENTION (1) Field of the Invention

The present invention relates to an improved paper feeding unit for use in electrostatic recording apparatuses such as copiers and the like, which is equipped with a paper-size detector means and a size indicator.

(2) Description of the Background Art

For example, a copier has a paper feeding unit composed of paper feed cassettes as a paper accommodating portion for accommodating regular-sized paper such as of B5, A4, B4, A3 and the like, a paper feeding mechanism for feeding paper in cassettes one by one, and a paper-size displaying portion for displaying the size of paper accommodated in the cassettes.

A typical paper-size indicating portion is composed of a detecting means for detecting the size of paper in a paper cassette and an indicating means for displaying the size of paper. Conventionally, the detecting means and the indicating means are independent from each other. The detecting means is dedicated only for detecting paper size while the indicating means is only for indicating paper size. Therefore, whenever the paper in the paper cassette is to be replaced with paper of another size, it is necessary to separately change the mode of the indicating means and display means. That is, the conventional configuration needs a troublesome operation, and forgetting to change one of them would cause an operational trouble.

As a method for solving such drawbacks, a paper-size indicting device is disclosed for example in Japanese Patent Application Laid-Open Hei 4 No. 327,431. In this paper-size indicating device, a paper accommodating portion which is adapted to accommodate paper of different sizes is formed and a detecting means is provided for the paper accommodating portion itself or in the vicinity of the paper accommodating portion. A indication/detection member composed of a signal portion to be detected by the detecting means and an indicating portion for displaying the size of the paper accommodated in the paper accommodating portion is further provided detachably in the paper accommodating portion itself or in the vicinity of the paper accommodating portion.

Specifically, this prior art apparatus includes: as shown in FIG. 1, paper-size indicators 41 to 44, detecting portions 46 to 49 each having different shapes and disposed on different four sides of a paper detection plate 45 and photo sensors 50 to 52 disposed so as to be opposed to one of the detecting portions, in order to display the paper size of one of the indicators 41 to 44 almost simultaneously as the paper size is detected. In this configuration, the apparatus detects paper size by detecting the shape of one of the detecting portions 46 to 49 opposed to the sensors 50 to 52 and at the same time indicates the paper size detected.

For example, if the detecting portion 46 is opposed to the side of the photosensors 50 to 52, sensors 50 and 51 are shaded while the A4-size indicator 41 is displayed. As another example, if the paper detection plate 45 is rotated 90 degrees clockwise about the point O, the detecting portion 47 is opposed to the side of the photosensors 50 to 52. In this case, sensors 51 and 52 are shaded while the B5-size indicator 42 is displayed.

However, in the above prior art example, detection and indication of paper size are performed by utilizing each side of a face having a maximum area of the one-piece paper detection plate 45. Accordingly, the paper detection plate 45 necessarily requires a large area and space. That is, the paper feeding apparatus is to feed paper as an essential function, but needs a large space for displaying paper size as a secondary function. This will also be an obstacle to downsizing of the paper cassette etc.

In order to better the above situation, it is considered to reduce the maximum length of the three-dimensional device. But, as one of the three dimensions is reduced, the other two dimensions increase, resulting in an awkward design requiring rather extra space for placement.

SUMMARY OF THE INVENTION

The present invention has been achieved in view of the above problems and it is therefore an object of the present invention to provide a paper feed unit wherein a paper detection means can be downsized with an optimal area for detection secured by forming the paper detection means of a regular-polygonal prism.

In accordance with a first aspect of the invention to attain the above object, a paper feeding unit includes: a paper holding receptacle capable of positioning and holding sheets of paper of a size selected from a plurality of different sizes; a paper feeding mechanism for separating sheets of paper held on the paper holding receptacle, one by one and feeding the separated sheet therefrom; a holder portion disposed in the paper holding receptacle or in the vicinity thereof; a detection block for detecting the size of paper placed on the paper holding receptacle, the detection block being held in the holder portion in such a manner that the posture or position of the detection block can be moved; a plurality of sensors disposed opposite to the detection block for detecting the paper size in accordance with the setup condition of the detection block; and an indicating means for displaying the size of paper placed on the paper holding receptacle based on the signals from the sensors generated in accordance with the position of the detection block held in the holder portion, and is constructed such that the detection block is composed of a regular-polygonal prism with at least one side face of the prism having a plurality of signal generating portions and being able to face the sensors.

In accordance with a second aspect of the invention, a paper feeding unit includes: a paper holding receptacle capable of positioning and holding sheets of paper of a size selected from a plurality of different sizes; a paper feeding mechanism for separating sheets of paper held on the paper holding receptacle, one by one and feeding the separated sheet therefrom; a detection block disposed in the paper holding receptacle or in the vicinity thereof for detecting the size of paper placed on the paper holding receptacle; a holder portion holding the detection block such that the detection block can be rotationally moved or axially shifted and be fixed at setup positions; a plurality of sensors disposed opposite to the detection block for detecting the paper size in accordance with the setup condition of the detection block; and an indicating means for displaying the size of paper placed on the paper holding receptacle based on the signals from the sensors generated in accordance with the position of the detection block held in the holder portion, and is constructed such that the detection block is composed of a regular-polygonal prism with at least one side face which has a plurality of signal generating portions and is able to face the sensors and the indicating means allows a paper-size indicator displayed on the signal generating portions of the detection block to be seen from the outside.

In accordance with a third aspect of the invention, a paper feeding unit includes: a paper feed cassette composed of a cassette body capable of accommodating sheets of paper of a size selected from a plurality of different sizes and fixing plates for positioning the sheets of paper of different sizes; and a paper feeding mechanism for separating sheets of paper held on the paper feed cassette, one by one and feeding the separated sheet therefrom, and the paper feed cassette further includes a front cover disposed in such a position as to face the outside, and the front cover is provided with: a detecting board having a plurality of sensors; a detection block for detecting the size of paper placed on the paper feed cassette, wherein the detection block is composed of a regular-polygonal prism with at least one side face of the prism which has a plurality of signal generating portions and is able to face the sensors; a holder portion holding the detection block such that the detection block can be rotationally moved or axially shifted and be fixed at setup positions; and a display window which allows a paper-size indicator displayed on the signal generating portions of the detection block to be seen from the outside.

In accordance with the above configurations, since the detection means is formed of a regular-polygonal prism, it is possible to downsize the paper detection means with an optimal area for detection secured. Further, it is also possible to increase the number of kinds of paper sizes to be detected. When the detection block is adapted to be rotationally moved and fixed at setup positions, the setup operation of paper sizes can be simplified. Further, when the detection block is adapted to be axially shifted, a plurality of paper sizes can be detected in a reduced space.

BRIEF DESCRIPTION OF THE DRAWINGS

FIG. 8A is a perspective view, including enlarged view FIG. 8B, showing a detection block and a detecting board in accordance with a second embodiment of the invention;

FIG. 8C is a sectional view of FIG. 8A, viewed from the direction of an arrow S;

DESCRIPTION OF THE PREFERRED EMBODIMENTS

Figure 1:
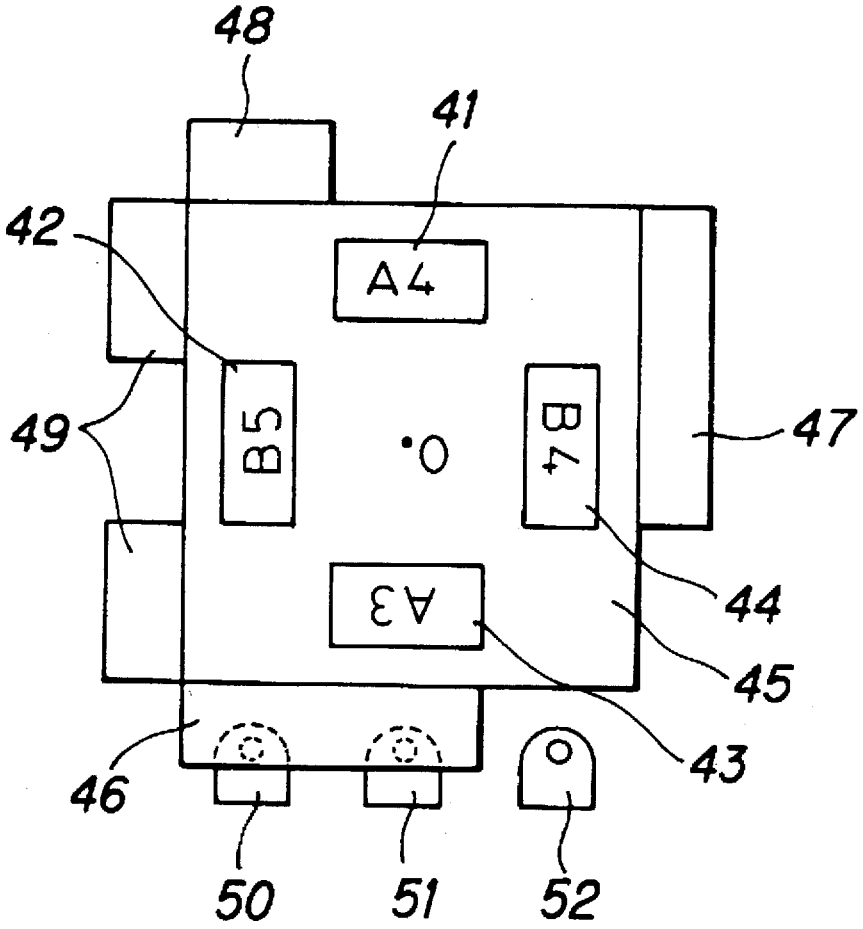
FIG. 1 PRIOR ART
FIG. 1 is a plan view showing a conventional example.
Figure 2:
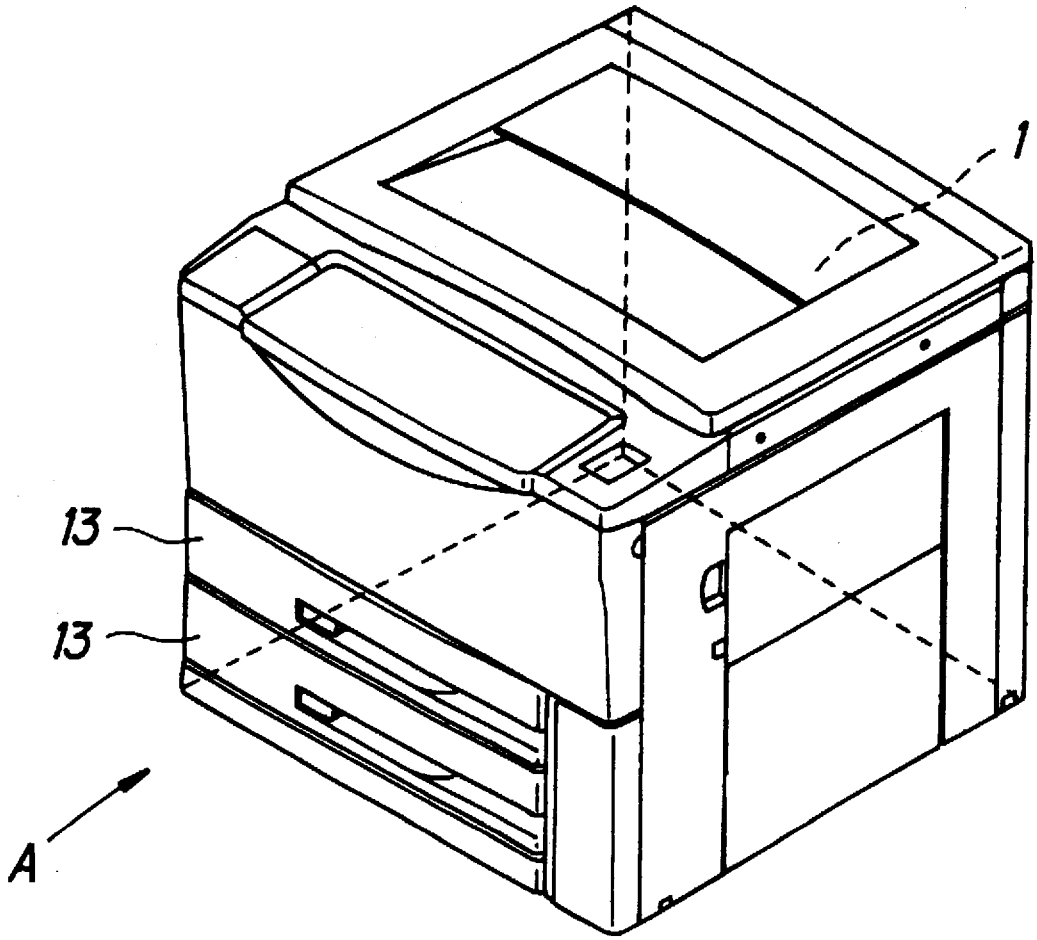
FIG. 2 is appearance perspective view showing an electrophotographic copier with a paper feeding unit incorporated in accordance with the invention.
Figure 3:
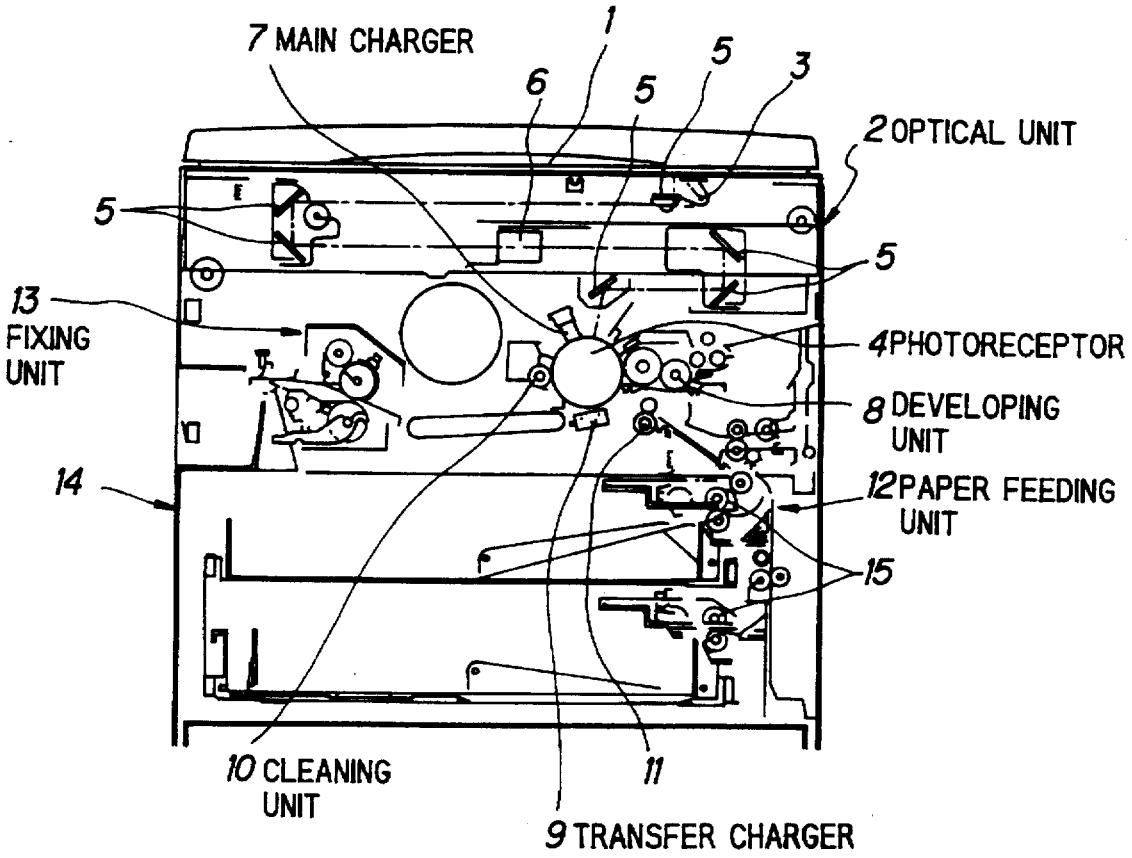
FIG. 3 is a vertical sectional view showing the copier of FIG. 2, viewed from the direction of an arrow A.
Figures 4, 4B:
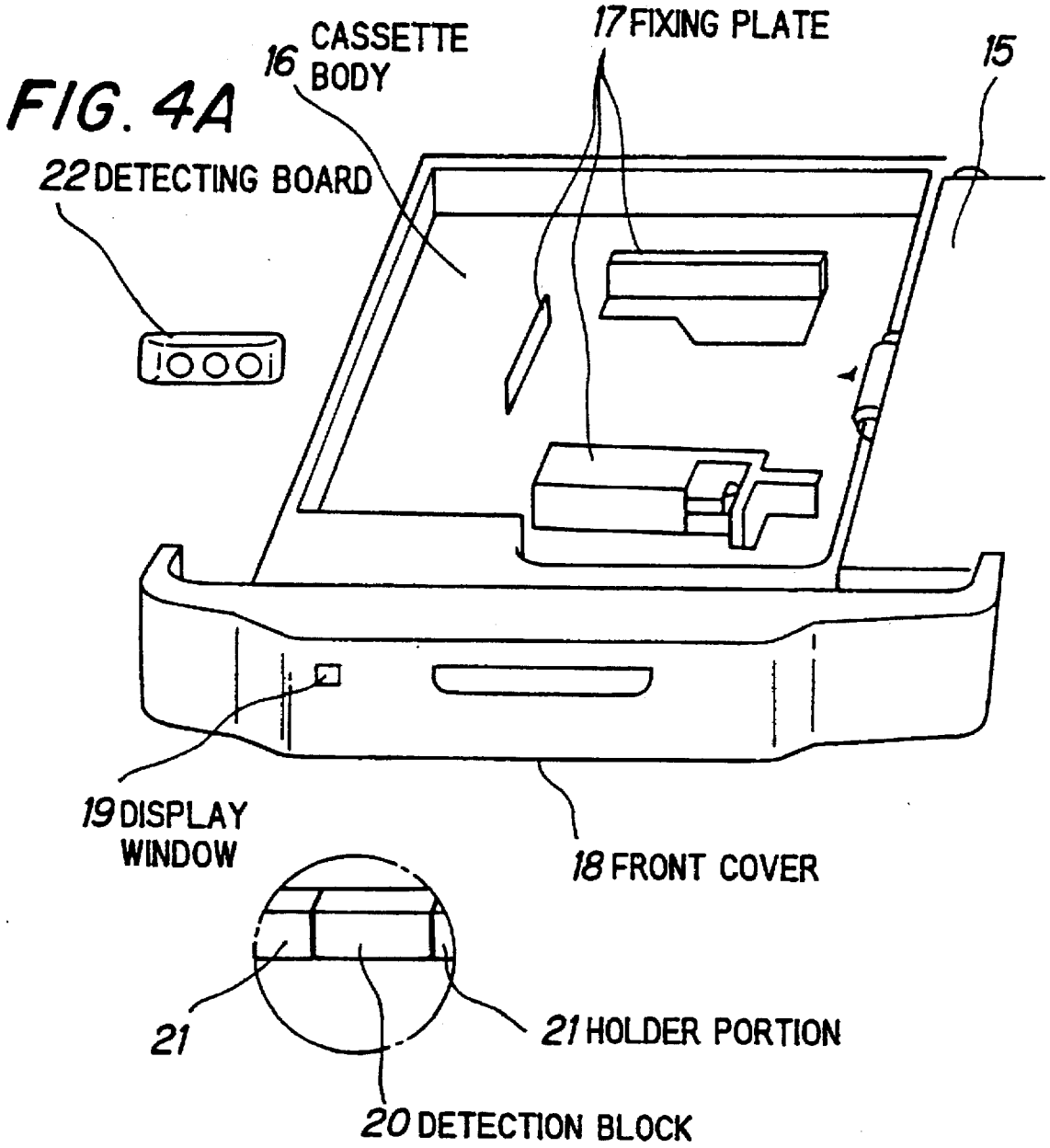
FIG. 4 is a perspective view, including enlarged views FIGS. 4A and 4B, showing essential parts of a paper feed cassette and a paper feeding unit in accordance with a first embodiment of the invention.
Figure 5A:
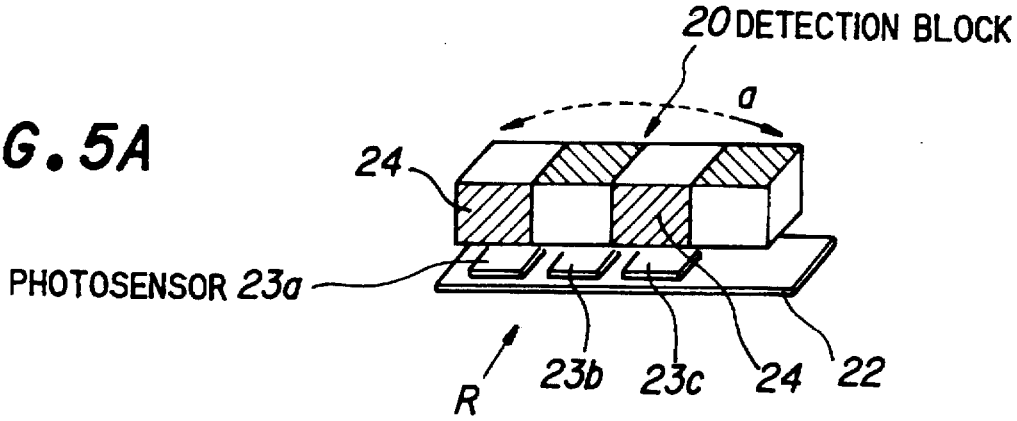
FIG. 5A is a perceptive view showing a detection block and a detecting board.
Figure 5B:
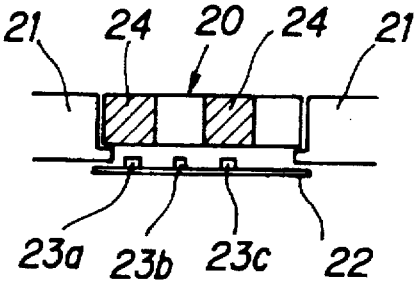
FIG. 5B is a sectional view of FIG. 5A, viewed from the direction of an arrow R.

Embodiments of the invention will hereinafter be described in detail with reference to the accompanying drawings. FIGS. 2 through 5A, 5B show a first embodiment of the invention. FIGS. 2 and 3 show an electrophotographic copier. FIG. 4 shows a paper feeding unit of this embodiment incorporated in the copier. FIGS. 5A and 5B show essential parts of the paper feeding unit.

In FIGS. 2 and 3, an original table 1 is provided on top of the copier. Provided under the original table 1 is an optical unit 2. The optical unit 2 comprises an exposure lamp 3 scanning the original placed on the original table 1 as illuminating the original, a plurality of mirrors 5 conducting reflected light from the original toward a photoreceptor 4, and a lens unit 6 disposed in the optical path of the reflected light.

Provided around the photoreceptor 4 are a main charger 7 charging the surface of the photoreceptor at a prescribed voltage, a developing unit 8 developing an electrostatic latent image formed on the surface of the photoreceptor 4, a transfer charger 9 transferring the toner image on the surface of the photoreceptor 4 onto the copy sheet, a cleaning unit 10 for collecting the residual toner on the photoreceptor surface, and the like. Disposed on the paper inserting side with respect to the photoreceptor 4 are a timing roller 11 feeding paper at a prescribed timing and a paper feeding unit 12 for feeding the paper toward the photoreceptor 4 in synchronism with the timing roller 11. On the other side of the photoreceptor 4 or on the paper discharging side, a fixing unit 13 is provided which fixes the toner image transferred on the sheet thereto.

Next, the copying operation in the thus configurated copier will be described. As the power switch unillustrated is turned on, the procedure of warming up is started. When after the completion of warm-up, the copy start switch on the control panel is activated, the exposure lamp 3 of the optical unit 2 scans the original placed on the original table 1. Reflected light from the original is conducted through a plurality of mirrors 5 and the lens unit 6 toward the photoreceptor 4 to be illuminated thereon, whereby an electrostatic latent image is formed on the photoreceptor 4 electrified at a prescribed voltage by means of the main charger 7.

Subsequently, the static latent image is visualized with the toner supplied from the developing unit 8. The toner image on the surface of the photoreceptor 4 is transferred to the sheet delivered from the paper feeding unit 12 by the transfer charger 9, and the transferred toner image is fused and fixed onto the sheet in the fixing unit 13. Thus, a copy image corresponding to the original image is created on the sheet. The above series of copying procedures are controlled by a controller including a microcomputer incorporated in the copier body.

In the copier thus configurated and operated, the paper feeding unit 12 includes a plurality of paper feed cassettes 14 vertically arranged with respective paper feeding mechanisms 15. Each paper feed cassette 14 accommodates a plurality of sheets and the paper feeding mechanism 15 is activated in synchronism with the timing roller 11, whereby sheets in the cassette are separated one by one to be delivered to the photoreceptor 4. Characteristic features of this embodiment are a detector for detecting the size of paper placed in the paper feed cassette 14 and a display for displaying the size.

Specifically, as shown in FIG. 4, each paper feed cassette 14 has a cassette body 16 as a paper tray capable of holding paper of different sizes. Provided in the cassette body 16 are a plurality of fixing plates 17 for positioning paper placement. Disposed on the front part facing the outside of the copier is a front cover 18 which has a display window 19 to one side. This window is to display the size of paper. A detection block 20, as illustrated in enlarged view FIG. 4B, for detection of paper size is disposed on the rear side inside the front cover 18 so as to face the display window 19 and fitted and held by a holder portion 21 while a detecting board 22, as illustrated in enlarged view FIG. 4A, for paper-size detection is disposed inside the front cover 18 below the detection block 20 so as to be opposite to the detection block 20.

The cassette body 16 is constructed so that it can be drawn in and out with respect to the copier body and is capable of accommodating different-sized sheets such as of B5, A4, B4 and A3. The fixing plates 17 are provided so as to be partially shifted in correspondence with the size of paper accommodated. When the cassette body 16 is drawn out of the copier body, positions of the fixing plates 17 can be changed and paper can be set. When the cassette body 16 is inserted into the copier body, the paper in the cassette can be fed by means of the feeding mechanism 15.

FIGS. 5A and 5B show the detection block 20 and the detecting board 22. FIG. 5B is a sectional view of FIG. 5A, viewed from the direction of an arrow R. In this figure, hatching shows sections with indicators such as B5, A4, B4, A3 and the like. As shown in FIGS. 5A and 5B, a plurality of photosensors, in these figures, three photosensors **23*a*, 23*b* and 23*c* are arranged on the detecting board 22 for detecting the paper size. These photosensors 23*a*, 23*b* and 23*c* each have a light emitting element p and a light receiving element q as shown in FIG. 6B**.

The detection block 20 is formed of a regular-polygonal prism, specifically a square prism and has a plurality of signal generating portions 24 on each face. These signal generating portions 24 are formed so as to correspond to any of the sensors **23*a*, 23*b* and 23*c*. This detection block 20 is attached to a holder portion 21** and detachably held thereby.

Figure 6A:
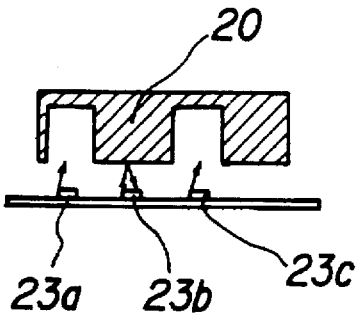
FIG. 6A is a sectional view showing the operation of an optical sensor unit.
Figure 6B:
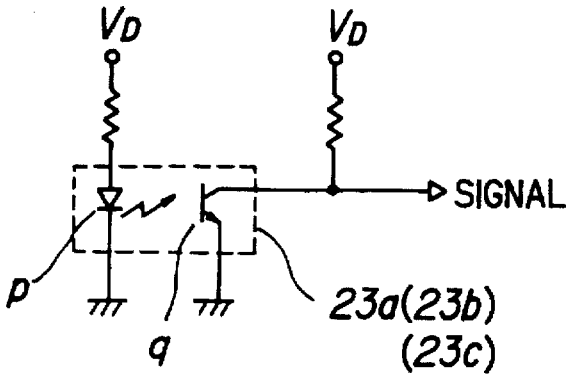
FIG. 6B is an electric circuit diagram equivalent to the optical sensor unit of FIG. 6A.

FIG. 6A shows the operation of the photosensors **23*a*, 23*b* and 23*c* in the above embodiment. Since the light from the sensor 23*a* goes into the hole of the detection block 20 and will not be reflected, the signal level becomes $V_D$ as understood from the circuit diagram FIG. 6B. The light from the sensor 23*b* is reflected on the surface of the detection block 20**, so that the signal level becomes GND. Combinations of these signals from the photosensors are used to perform size detection.

Figure 7:
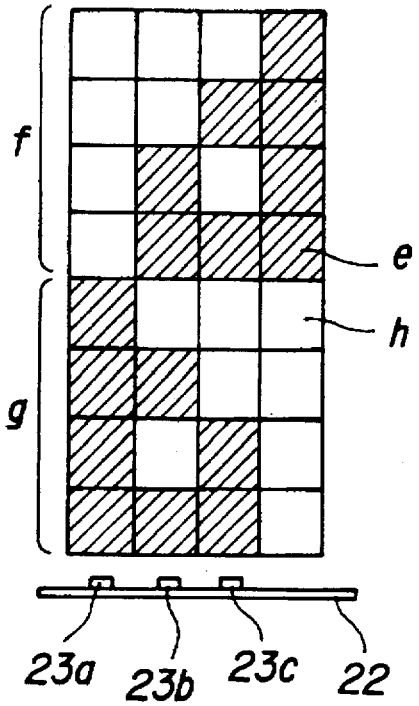
FIG. 7 is a view showing a development of a detection block.

FIG. 7 is an example of a development of the detection block 20. As shown in the figure, hole-patterns 'g' are the invert of hole-patterns 'f' of the detection block 20, so that it is possible to increase the number of paper sizes to be detected. Reference numerals **23*a* to 23*c* are photosensors, hatched portions 'e' indicate sections with a hole in the detection block 20** and blank portions 'h' indicate sections with no hole.

In the thus configurated paper feeding unit, a user of the copier sets sheets of paper in the paper feed cassette 14 and places the detection block 20 into the holder portion 21 in conformity with the size of paper in the cassette. In this setting, the photosensors **23*a*, 23*b* and 23*c* on the detecting board 22 which faces the signal generating portions 24 of the detection block 20, detect signals from the signal generating portions 24, to thereby detect the size of paper in the paper feed cassette 14. Further, by turning the placement of the detection block 20 right-side left as indicated by an arrow 'a' in FIG. 5A, it is possible to change the combinations of sensors 23 of the detecting board 22 to be faced to the signal generating portions 24**. Accordingly, it is possible to increase the number of sizes to be detected.

More specifically, the signal generating portions 24 of the detection block 20 are arranged with respect to the sensor array 23 in a predetermined manner such as an alternating manner or the like. For example, suppose that for A4-size paper, the array of the signal generating portions 24 of the detection block 20 is arranged so that the Sensors **23*a* and 23*c* will be turned on, while for A3-size paper, the array of the signal generating portions 24 of the detection block 20 is arranged so that only the sensor 23*b*** will be detected.

Now, suppose that A4-size sheets are set in the paper feed cassette 14. In this case, if the detection block 20 is mounted so that the array of the signal generating portions 24 conforms with the size, the indicator of A4 will be displayed from the display window 19. Next, when A3-size sheets are set in; as the detection block 20 is turned right-side left, the array of the signal generating portions 24 takes a form of activating only the sensor **23*b* and the indicator of A3 will be displayed from the display window 19. Further, one of the other faces of the detection block 20 is adapted to have an array of signal generating portions 24** suited to B-sizes, it is possible to similarly display B5 and B4 sizes, for example.

Thus, in accordance with this embodiment, the detection block 20 of a square prism is adapted to be held in a position- or posture-variable manner by the holder portion 21 while a plurality of sensors **23*a*, 23*b* and 23*c* are disposed opposite to the detection block 20 in order to detect the paper size corresponding to the setup state of the detection block 20. In this arrangement, the size of paper set in the paper feed cassette 14 is displayed on the display window 19 based on the signals generated by the sensors 23*a*, 23*b* and 23*c* in conformity with the position of the detection block 20 held in the holder 21. Accordingly, it is possible to optimally secure the areas of the paper-size detecting portion and indicator portion of the paper feeding unit 12** and reduce the sizes of these parts.

FIGS. 8A, 8B and 8C show a detection block 20 and a detecting board 22 in a second embodiment of the invention. FIG. 8C is a sectional view of FIG. 8A, viewed from the direction of an arrow S. The overall configuration of a paper feeding unit 12 used in this embodiment is the same with that in the first embodiment shown in FIG. 4 and the description will be omitted to avoid repetition. In this embodiment, the detection block 20 is formed with a rotatable shaft 25 and a boss-like rotation stopper projection 26 coaxial with the shaft, so that the detection block 20 can be rotated and stopped.

In this case, one side of the holder portion is provided as a fixed mount 21*a* for the detection block 20 and the fixed mount has the rotation stopper projection 26 formed on the end face thereof opposite to the detection block 20. The other side of the holder portion incorporates a shift device 21*b* of the detection block 20. This shift device 21*b*, as illustrated in greater detail in enlarged view FIG. 8B, includes a spring 27 provided coaxially with the shaft 25 and is Constructed so that the shaft 25 is urged by the spring toward the direction shown by arrow b in FIG. 8A.

In the above configuration, when the detection block 20 is moved toward the direction of an arrow b' in FIG. 8A by opposing the urging force of the spring 27, the press-fixed state between the rotation stopper projection 26 and the fixed mount 21*a* is released so as to allow the detection block 20 to rotate in the direction of an arrow c. Then, when the detection block 20 is moved in the direction of arrow b complying with the urging force of the spring 27, the detection block 20 is fixed by the engagement between the rotation stopper projection 26 and the fixed mount 21*a*, whereby it is possible to set up a size of paper.

Thus, in this embodiment, since the rotation stopper projection 26 is provided for the detection block 20 and the spring 27 as an elastic member is interposed between the shift device 21*b* and the detection block 20 as the other part of the holder portion, the detection block 20 is urged toward the fixed mount 21*a* as one side of the holder portion so that the rotation of the detection block 20 can be inhibited by means of the rotation stopper projection 26 and when the detection block 20 is moved by opposing the urging force of the spring 27, the detection block 20 can be shifted to a position where the detection block 20 is disengaged from the rotation stopper projection 26. In this position, the detection block 20 can be rotated relative to the sensors 23*a*, 23*b*, . . . of the detecting board 22 so that the opposite face of the block to the sensors can be changed. Accordingly, it is possible to reduce the number of attaching and removal operations of the detection block when the paper size is changed, and therefore it is possible to simplify the setup operation of paper sizes.

Figure 9A:
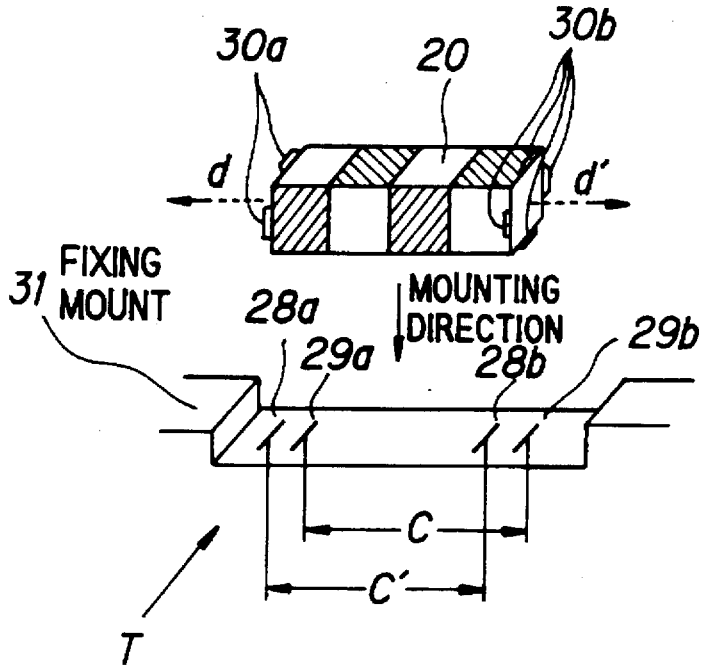
FIG. 9A is a perspective view showing a detection block and a detecting board in accordance with a third embodiment of the invention.
Figure 9B:
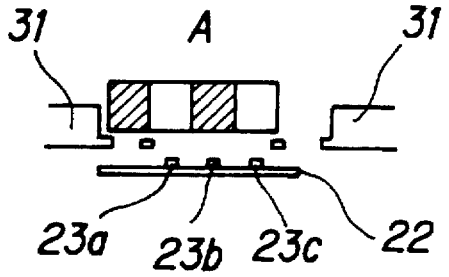
FIG. 9B is a sectional view of FIG. 9A, viewed from the direction of an arrow T, wherein the detection block is fixed at a position C'.
Figure 9C:
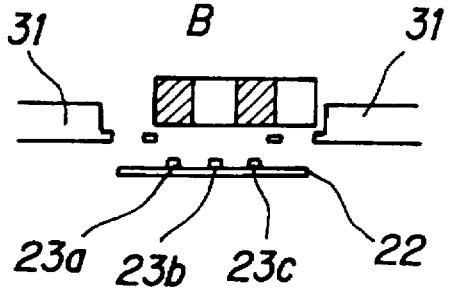
FIG. 9C is a sectional view of FIG. 9A, viewed from the direction of an arrow T, wherein the detection block is fixed at a position C.

FIGS. 9A, 9B and 9C show a detection block 20 and a detecting board 22 in a third embodiment of the invention. FIGS. 9B and 9C are both sectional views of FIG. 9A, viewed from the direction of an arrow T. FIG. 9B shows a state in which the detection block 20 is fixed at a position C' while FIG. 9C shows a state in which the detection block 20 is fixed at a position c. The overall configuration of a paper feeding unit 12 used in this embodiment is the same with that in the first embodiment shown in FIG. 4 and the description will be omitted to avoid repetition. In this embodiment, the detection block 20 is adapted to shift from one side to another, resulting in reduction of the occupied space and thereby a plurality of paper sizes are detected by the small amount of movement.

That is, in this embodiment, in place of turning the sides of the detection block 20, the detection block 20 is shifted axially or in the directions of arrows d and d', so that the block 20 is positioned between a first position A and a second position B. That is, it is possible to detect a size of paper at either position. For this purpose, holding slots 28*a* and 28*b*, and 29*a* and 29*b* are provided to hold the detection block 20 to the sensor array of the detecting board 22, at the first position A and at the second position B, respectively. The first position A and the second position B are shifted from one another by a distance of intervals of the sensors 23*a*, 23*b* and 23*c*.

Specifically, projections 30*a* and 30*b* are formed on both sides of the detection block 20 with respect to the axial direction while holding slots 28*a*, 28*b*, 29*a* and 29*b* are formed on a fixing mount 31 for fixing the detection block 20. In this configuration, it is possible to shift the detection block 20 in the directions of arrows d and d' and set the detection block 20 in both the position C' where the detection block 20 is fitted in the holding slots 28*a* and 28*b* and in the position C where the detection block 20 is fitted in the holding slots 29*a* and 29*b*. At each position the block can manually be rotated to set up different size modes, therefore it is possible for this configuration to detect twice as many kinds of sizes as in the case where the block is rotated at a fixed site.

Thus, in this embodiment, by providing projections 30*a* and 30*b* on both sides of the detection block 20 and forming holding slots 28*a*, 28*b*, 29*a* and 29*b* on the fixing mount 31 for the detection block 20, it is possible to detect plural kinds of paper sizes by moving the detecting block in a small amount in a reduced space.

Figure 10A:
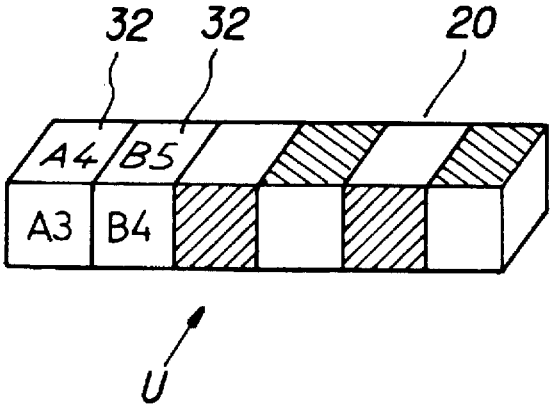
FIG. 10A is a perspective view showing a detection block in accordance with a fourth embodiment of the invention.
Figure 10B:
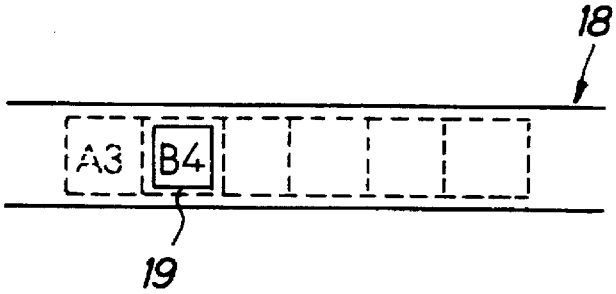
FIG. 10B is a front view of FIG. 10A, viewed from the direction of an arrow U, showing a state before the detection block is shifted.
Figure 10C:
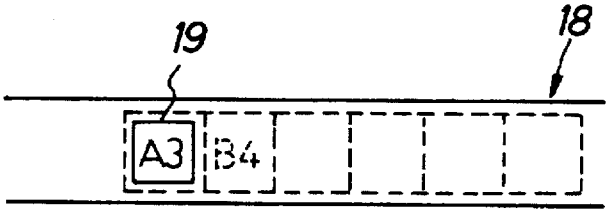
FIG. 10C is a front view of FIG. 10A, viewed from the direction of an arrow U, showing a state after the detection block is shifted.

FIGS. 10A, 10B and 10C show a detection block 20 in a fourth embodiment of the invention. FIGS. 10B and 10C are both sectional views of FIG. 10A, viewed from the direction of an arrow U. FIG. 10B shows a state before the detection block 20 is shifted and FIG. 10C shows a state after the detection block 20 is shifted. The overall configuration of a paper feeding unit 12 used in this embodiment is the same with that in the first embodiment shown in FIG. 4 and the description will be omitted to avoid repetition. In this embodiment, the detection block 20 is adapted to shift from one side to another, resulting in reduction of the occupied space and thereby a plurality of paper sizes are detected and displayed by the small amount of movement.

That is, in this embodiment, the detection block 20 has paper-size indicators 32 at one axial end portion thereof in addition to the configuration of the above third embodiment, and when the detection block 20 is shifted from one side to another and moved in a small amount, one selected from a plurality of paper-size indications is adapted to be displayed through the display window 19 which is formed on the front cover 18. Therefore, by this embodiment thus configurated, it is possible to simplify the setup operation of paper sizes as well as to detect plural kinds of paper sizes in a reduced space.

Figure 11A:
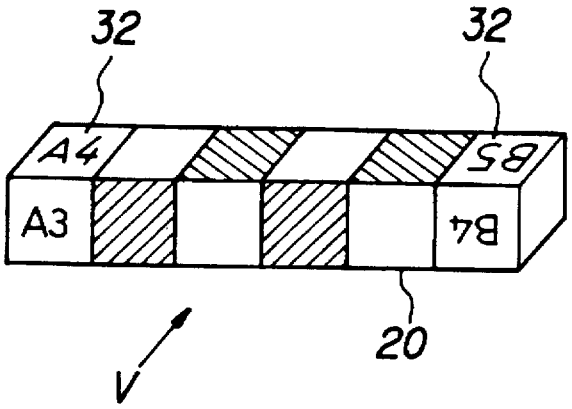
FIG. 11A is a perspective view showing a detection block in accordance with a fifth embodiment of the invention.
Figure 11B:
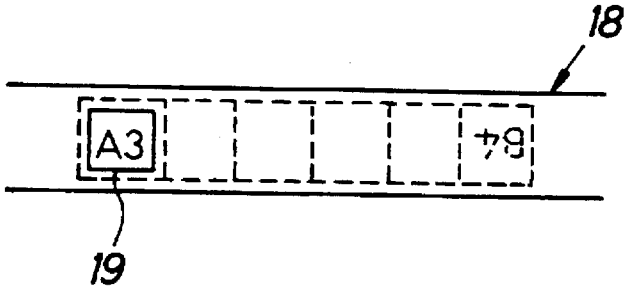
FIG. 11B is a front view of FIG. 11A, viewed from the direction of an arrow V, showing a state before the detection block is inverted.
Figure 11C:
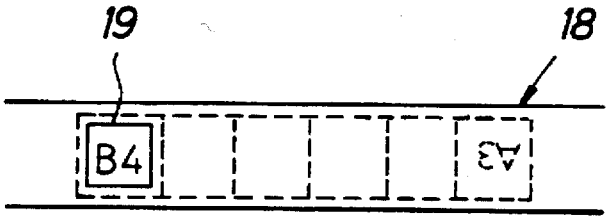
FIG. 11C is a front view of FIG. 11A, viewed from the direction of an arrow V, showing a state after the detection block is inverted.

FIGS. 11A, 11B and 11C show a detection block 20 in a fifth embodiment of the invention. FIGS. 11B and 11C are both sectional views of FIG. 11A, viewed from the direction of an arrow V. FIG. 11B shows a state before the detection block 20 is inverted and FIG. 11C shows a state after the detection block 20 is inverted. The overall configuration of a paper feeding unit 12 used in this embodiment is the same with that in the first embodiment shown in FIG. 4 and the description will be omitted to avoid repetition. In this embodiment, paper-size indicators 32 are provided on both axial extremes of the detection block 20 so that the size indicator can be seen through a single display window 19 even if the side of the detection block 20 is turned for size change.

That is, the addition of the paper-size indicators 32 to the detection block 20 shown in FIGS. 5A and 5B makes it possible to display the paper size detected from the detection block 20, through the display window 19 in the front cover 18 of the paper feed cassette. Accordingly, it is possible to simplify the setup operation of paper sizes as well as to detect plural kinds of paper sizes in a reduced space.

Figure 12A:
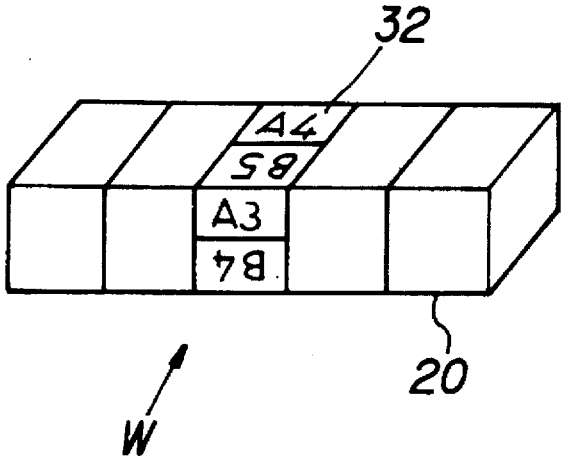
FIG. 12A is a perspective view showing a detection block in accordance with a sixth embodiment of the invention.
Figure 12B:
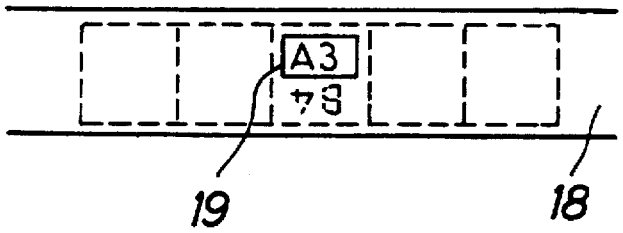
FIG. 12B is a sectional view of FIG. 12A, viewed from the direction of an arrow W.

FIG. 12A and 12B show a detection block 20 in a sixth embodiment of the invention. FIGS. 12B is a sectional view of FIG. 12A, viewed from the direction of an arrow W. The overall configuration of a paper feeding unit 12 used in this embodiment is the same with that in the first embodiment shown in FIG. 4 and the description will be omitted to avoid repetition. In this embodiment, the detection block 20 is devised so that the volume of the block can be reduced and the size indicator can be displayed through a single display window 19 even if the side of the detection block 20 is turned for size change.

That is, the addition of the paper-size indicators 32 into the middle of the detection block 20 shown in FIGS. 5A and 5B makes it possible to display the paper size detected from the detection block 20, through the display window 19 of the front cover 18 of the paper feed cassette. Further, two indicators are formed up and down on a single segment of the detection block 20 and the same segment can be used to display the size of paper when it is turned one side to the other. Thus, in accordance with this embodiment, it is possible to detect and display plural kinds of paper sizes while it is also possible to realize simplification of the paper-size setup operation as well as to reduce the space required for the detection.

Figure 13A:
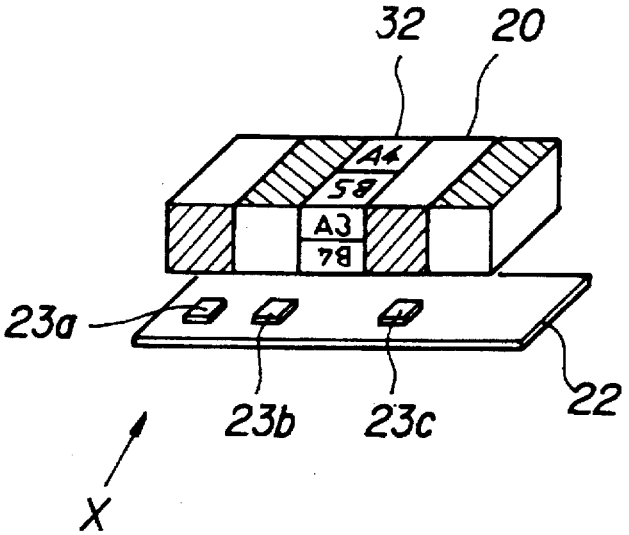
FIG. 13A is a perspective view showing a configurational example of integration of the first and sixth embodiments.
Figure 13B:
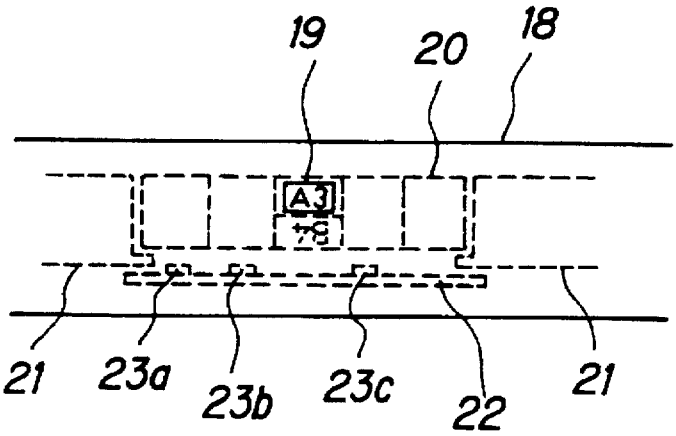
FIG. 13B is a sectional view of FIG. 13A, viewed from the direction of an arrow X.

FIG. 13A is a perspective view showing a detection block 20 and a detecting board 22 and is an integrated configurational example of the first and sixth embodiments. These elements are assembled in the paper feed unit 12 shown in FIG. 4 in the following geometry in order to simplify its structure. That is, as to the detection block 20, the directions of insertion and removal, the direction of shift, the orientation of detection of paper sizes and the orientation of the indication of the paper size detected are made different. More specifically, the paper feed unit 12 includes a paper feed mechanism 15, fixing plates 17, a detection block 20, a holder portion 21, a detecting board 22 opposite to the detection block 20 and a display window 19 on a different side from that of the detection side of the detecting block 20, and when the detection block 20 is set in the holder portion 21, the geometry is such that the detection block 20 is shifted horizontally, the detection face of the block is oriented downward; both are made different from the front direction toward which the display window 19 faces. FIG. 13B is a sectional view of FIG. 13A, viewed from the direction of an arrow X.

Specifically, the simple structure in which the paper-size indicators 32 shown in FIGS. 13A and 13B or FIGS. 12A and 12B are added to the detection block 20 shown in FIGS. 5A and 5B, makes it possible to display the paper size detected from the detection block 20, through the display window 19 in the front cover 18 of the paper feed cassette.

As has been described heretofore, in accordance with the invention, since the detector is composed of a regular-polygonal prism, it is possible to downsize the paper-size detector while the area of the paper-size detector is optimally secured. Further, it is also possible to increase the number of kinds of paper sizes to be detected.

Further in accordance with the invention, since the detection block can be rotationally variable and fixed at setup positions, it is possible to simply the setup operation of paper sizes. In accordance with another aspect of the invention, since the detection block can be shifted in its axial direction, it is possible to detect plural kinds of paper sizes in a reduced space.

What is claimed is:

1. A paper feeding unit comprising:

a paper holding receptacle capable of positioning and holding sheets of paper of a size selected from a plurality of different sizes;

a paper feeding mechanism for separating sheets of paper held on said paper holding receptacle, one by one and feeding the separated sheets therefrom;

a holder portion disposed in said paper holding receptacle;

a detection block being held in said holder portion in such a manner that a posture or position of said detection block, indicative of the size of paper held by said paper holding receptacle, can be moved;

a plurality of sensors disposed opposite to said detection block for generating detection signals based on the posture or position of said detection block as held in said holder portion, the detection signals being indicative of the size of paper; and indicating means for displaying the size of paper held by said paper holding receptacle based on the detection signals generated by said plurality of sensors, said detection block being a regular-polygonal prism with at least one side face having a plurality of signal generating portions which face said plurality of sensors.

2. The paper feeding unit of claim 1, wherein each of said plurality of sensors comprise:

a light emitter for emitting light toward a respective one of said plurality of signal generating portions of said detection block; and a light receiver for receiving the emitted light reflected by the respective one of said plurality of signal generating portions and generating a corresponding one of the detection signals in accordance with the received light.

3. The paper feeding unit of claim 2, wherein said at least one side face of said regular-polygonal prism includes a plurality of reflective surfaces as said plurality of signal generating portions and non-reflective portions which do not reflect the emitted light from said light emitter.

4. The paper feeding unit of claim 3, wherein said non-reflective portions comprise holes formed in said at least one side face of said regular-polygonal prism.

5. The paper feeding unit of claim 1, wherein said regular-polygonal prism has a plurality of side faces having further signal generating portions, each of said plurality of side faces having respective projections at opposite longitudinal first and second ends, said holder portion having plural slots formed therein, the posture or position of said regular-polygonal prism within said holder portion being selectable according to which of said plural slots said projections are placed in.

6. The paper feeding unit of claim 5, wherein the posture or position of said regular-polygonal prism within said holder portion is selectable in a longitudinal direction of said regular-polygonal prism in accordance with which of said plural slots said projections are placed in.

7. The paper feeding unit of claim 1, wherein said regular-polygonal prism has a plurality of side faces having further signal generating portions, said regular-polygonal prism being rotatable about a longitudinal axis such that said plurality of side faces are movable within said holder portion to face said plurality of sensors.

8. The paper feeding unit of claim 1, wherein said paper holding receptacle comprises a display window, said plurality of signal generating portions having paper-size indicators formed thereon viewable through said display window.

9. A paper feeding unit comprising:

a paper holding receptacle capable of positioning and holding sheets of paper of a size selected from a plurality of different sizes;

a paper feeding mechanism for separating sheets of paper held on said paper holding receptacle, one by one and feeding the separated sheets therefrom;

a detection block disposed in said paper holding receptacle;

a holder portion holding said detection block such that said detection block can be rotationally moved or axially shifted and can be fixed at setup positions indicative of the size of paper held by said paper holding receptacle;

a plurality of sensors disposed opposite to said detection block for generating detection signals based on the setup position of said detection block, the detection signals being indicative of the size of paper; and indicating means for displaying the size of paper held by said paper holding receptacle based on the detection signals generated by said plurality of sensors, said detection block being a regular-polygonal prism with at least one side face having a plurality of signal generating portions which face said plurality of sensors, said indicating means displaying a paper-size indicator formed on said signal generating portions of said detection block.

10. The paper feeding unit of claim 9, wherein each of said plurality of sensors comprise:

a light emitter for emitting light toward a respective one of said plurality of signal generating portions of said detection block; and a light receiver for receiving the emitted light reflected by the respective one of said plurality of signal generating portions and generating a corresponding one of the detection signals in accordance with the received light.

11. The paper feeding unit of claim 10, wherein said at least one side face of said regular-polygonal prism includes a plurality of reflective surfaces as said plurality of signal generating portions and non-reflective portions which do not reflect the emitted light from said light emitter.

12. The paper feeding unit of claim 11, wherein said non-reflective portions comprise holes formed in said at least one side face of said regular-polygonal prism.

13. The paper feeding unit of claim 9, wherein said regular-polygonal prism has a plurality of side faces having further signal generating portions, each of said plurality of side faces having respective projections at opposite longitudinal first and second ends, said holder portion having plural slots formed therein, the posture or position of said regular-polygonal prism within said holder portion being selectable according to which of said plural slots said projections are placed in.

14. The paper feeding unit of claim 13, wherein the posture or position of said regular-polygonal prism within said holder portion is selectable in a longitudinal direction of said regular-polygonal prism in accordance with which of said plural slots said projections are placed in.

15. The paper feeding unit of claim 9, wherein said regular-polygonal prism has a plurality of side faces having further signal generating portions, said regular-polygonal prism being rotatable about a longitudinal axis such that said plurality of side faces are movable within said holder portion to face said plurality of sensors.

16. The paper feeding unit of claim 9, wherein said paper holding receptacle comprises a display window, said plurality of signal generating portions having paper-size indicators formed thereon viewable through said display window.

17. A paper feeding unit comprising:

a paper feed cassette composed of a cassette body capable of accommodating sheets of paper of a size selected from a plurality of different sizes and fixing plates for positioning said sheets of paper of different sizes; and a paper feeding mechanism for separating sheets of paper held by said paper feed cassette, one by one and feeding the separated sheets therefrom, said paper feed cassette further including a front cover disposed in such a position as to be externally viewable, said front cover being provided with a detecting board having a plurality of sensors, a detection block composed of a regular-polygonal prism with at least one side face having a plurality of signal generating portions which face said plurality of sensors, a holder portion holding said detection block such that said detection block can be rotationally moved or axially shifted and can be fixed at setup positions indicative of the size of paper held by said paper feed cassette, and a display window which displays a paper-size indicator displayed on said signal generating portions of said detection block.

18. A paper holding receptacle for a paper feeding unit, the paper holding receptacle capable of holding sheets of paper of a size selected from a plurality of different paper sizes, comprising:

a holder;

a regular-polygonal prism, manipulable within said holder to one of plural positions, for providing indication of the size of paper held by the paper holding receptacle, each of the plural positions being indicative of a respective different paper size;

a plurality of sensors disposed in the vicinity of said regular-polygonal prism for generating detection signals based on the position of said regular-polygonal prism as held in said holder, the detection signals being indicative of the size of paper held by the paper holding receptacle; and display means for displaying the size of paper held by the paper holding receptacle in accordance with the detection signals.

19. The paper holding receptacle of claim 18, wherein said regular-polygonal prism has at least one side face having a plurality of signal generating portions which face said plurality of sensors, each of said plurality of sensors comprising:

a light emitter for emitting light toward a respective one of said plurality of signal generating portions of said regular-polygonal prism; and a light receiver for receiving the emitted light reflected by the respective one of said plurality of signal generating portions and generating a corresponding one of the detection signals in accordance with the received light.

20. The paper holding receptacle of claim 19, wherein said at least one side face of said regular-polygonal prism includes a plurality of reflective surfaces as said plurality of signal generating portions and non-reflective portions which do not reflect the emitted light from said light emitter.

21. The paper holding receptacle of claim 20, wherein said non-reflective portions comprise holes formed in said at least one side face of said regular-polygonal prism.

22. The paper holding receptacle of claim 18, wherein said regular-polygonal prism has a plurality of side faces each having a plurality of signal generating portions and respective projections at opposite longitudinal first and second ends, said holder having plural slots formed therein, the position of said regular-polygonal prism within said holder being selectable according to which of said plural slots said projections are placed in.

23. The paper holding receptacle of claim 22, wherein the position of said regular-polygonal prism within said holder is selectable in a longitudinal direction of said regular-polygonal prism in accordance with which of said plural slots said projections are placed in.

24. The holding receptacle of claim 18, wherein said regular-polygonal prism has a plurality of side faces each having a plurality of signal generating portions, said regular-polygonal prism being rotatable about a longitudinal axis such that said plurality of side faces are movable within said holder to face said plurality of sensors.

25. The paper holding receptacle of claim 18, wherein said plurality of signal generating portions have paper-size indicators formed thereon viewable through said display means.

* * * * *